United States Patent [19]

Yoshida et al.

[11] Patent Number: 4,785,330

[45] Date of Patent: Nov. 15, 1988

[54] MULTIPLE IMAGE FORMING SYSTEM

[75] Inventors: Nobutoshi Yoshida, Yokohama; Atushi Takagi, Minami-Ashigara, both of Japan

[73] Assignee: Canon Kabushiki Kaisha, Tokyo, Japan

[21] Appl. No.: 110,280

[22] Filed: Oct. 20, 1987

[30] Foreign Application Priority Data

Oct. 23, 1986 [JP] Japan ..... 61-253307
Oct. 27, 1986 [JP] Japan ..... 61-255105

[51] Int. Cl.[4] ..... G03G 15/04; G03G 15/06

[52] U.S. Cl. ..... 355/14 R; 355/14 E; 355/14 D; 355/14 CH; 355/7

[58] Field of Search ..... 355/14 E, 14 D, 14 CH, 355/14 R, 7, 3 R

[56] References Cited

U.S. PATENT DOCUMENTS 4,583,839 4/1986 Suzuki ..... 355/14 E
4,701,044 10/1987 Horiuchi et al. ..... 355/14 E
4,707,709 11/1987 Tsilibes ..... 355/14 E
4,720,729 1/1988 Watanabe ..... 355/14 E

*Primary Examiner*—R. L. Moses
*Attorney, Agent, or Firm*—Fitzpatrick, Cella, Harper & Scinto

[57] ABSTRACT

A multiple image forming system for synthesizing images having different kinds of gradation characteristics of an original comprises: a latent image forming circuit for projecting a reflected light from the original onto a photo sensitive drum and forming an electrostatic latent image onto this drum; a developing unit to develop the latent image; and a control circuit to make the latent image forming circuit and the developing unit operative every gradation characteristic for the different gradation characteristic areas in the original, wherein the control circuit changes the latent image forming conditions such as an amount of exposing light to the original of the latent image forming circuit and the developing conditions such as a developing bias of the developing unit in accordance with the kind of gradation characteristic. With this system, the image areas having different kinds of gradation characteristics which mixedly exist in one original are automatically detected and the latent image forming circuit is automatically properly controlled, so that the proper image is reproduced.

32 Claims, 13 Drawing Sheets

START
PRE-SCAN
SET LAMP VOLTAGE FOR 60V AND TURN OFF DEVELOPING UNIT
RECOGNIZE AREA OF ORIGINAL
REFERENCE-ORIGINAL AREA ?
NO
YES
FLAG F1=1
FLAG F1=0
NEWS-PAPER-ORIGINAL AREA ?
NO
YES
FLAG F2=1
FLAG F2=0
PHOTOGRAPH-ORIGINAL AREA ?
NO
YES
FLAG F3=1
FLAG F3=0
F1=1 ?
NO
YES
LAMP VOLTAGE=60V
VPP = 1400V
F = 2000Hz
VDC = -220V
IMAGE FORMING OF REFERENCE-ORIGINAL AREA

STEP 1
STEP 2

MULTIPLE IMAGE FORMING SYSTEM

BACKGROUND OF THE INVENTION

1. Field of the Invention

The present invention relates to a multiple image forming system for synthesizing and forming a plurality of images having different characteristics.

2. Related Background Art

Hitherto, in the case where the portions having different gradations, for example, the character portion and the photograph portion or low contrast portion mixedly exist on the same original, a density reducing dial or photograph mode selection key or the like is operated in accordance with the portion whose occupying rate is larger or with the portion to be emphasized and the images are then copied. However, according to such a method, the image in the other portion is frequently certainly sacrificed. For example, when the images were copied in accordance with the character portion, the gradations in the photograph portion become poor, so that the images in the photograph portion become hard. On the contrary, when the images were copied in accordance with the photograph portion, the density of the images in the character portion is reduced or the images in the character portion easily become fogging.

For example, when copying an original in which cut-out photograph originals and newspaper originals mixedly exist in one original proper image forming means does not exist for all of the originals such as photograph original which needs gradations and newspaper original which requires that the fogging does not occur. Therefore, in most cases, the user usually selects image forming means such that a reference original can be properly copied. Thus, even if a proper image was derived for a reference original as a base, the image of a cut-out photograph original has the poor gradations. On the other hand, in the case of a newspaper original, an image such that the background portion is fogging is obtained. It is difficult to obtain an image suitable for all of the mixed originals.

The applicant of this invention has proposed a multiple copying system in which areas of an original are designated and each area is reproduced in different color in U.S. patent application Ser. No. 830,745 (Feb. 19, 1986).

The applicant of this invention has also proposed various kinds of systems in which an image of an original is read as a form of an electric signal and a different process is performed every area having different gradation characteristic in U.S. Pat. No. 4,414,581, U.S. patent applications Ser. No. 640,539 (Aug. 14, 1984), Ser. No. 580,821 (Feb. 16, 1984), Ser. No. 022,513 (Mar. 9, 1987), Ser. No. 058,625 (Jun. 4, 1987), Ser. No. 644,558 (Aug. 27, 1984), Ser. No. 650,267 (Sep. 13, 1984), Ser. No. 022,606 (Mar. 5, 1987), etc.

However, in a copying apparatus of the type in which the light of an image is directly irradiated onto a photo sensitive material, a system for executing the process every area having a different gradation characteristic does not exist yet.

SUMMARY OF THE INVENTION

It is an object of the present invention to provide a multiple image forming system which can eliminate the foregoing drawbacks in the conventional techniques.

Another object of the invention is to provide a multiple image forming system for forming a multiple image by changing the gradations of respective images in a plurality of areas of an original.

Still another object of the invention is to provide a multiple image forming system in which even if the original portions having different kinds of gradation characteristics mixedly exist in one original, the original areas having the different kinds of characteristics are automatically detected and proper image forming means is automatically controlled for each original, thereby enabling a proper image to be reproduced.

The above an other objects and features of the present invention will become apparent from the following detailed description and the appended claims with reference to the accompanying drawings.

BRIEF DESCRIPTION OF THE DRAWINGS

FIGS. 18 and 19 are flowcharts showing the control operations of a controller 109 in the second embodiment.

DETAILED DESCRIPTION OF THE PREFERRED EMBODIMENTS

A method of changing the gradation will be first described.

Figure 9:
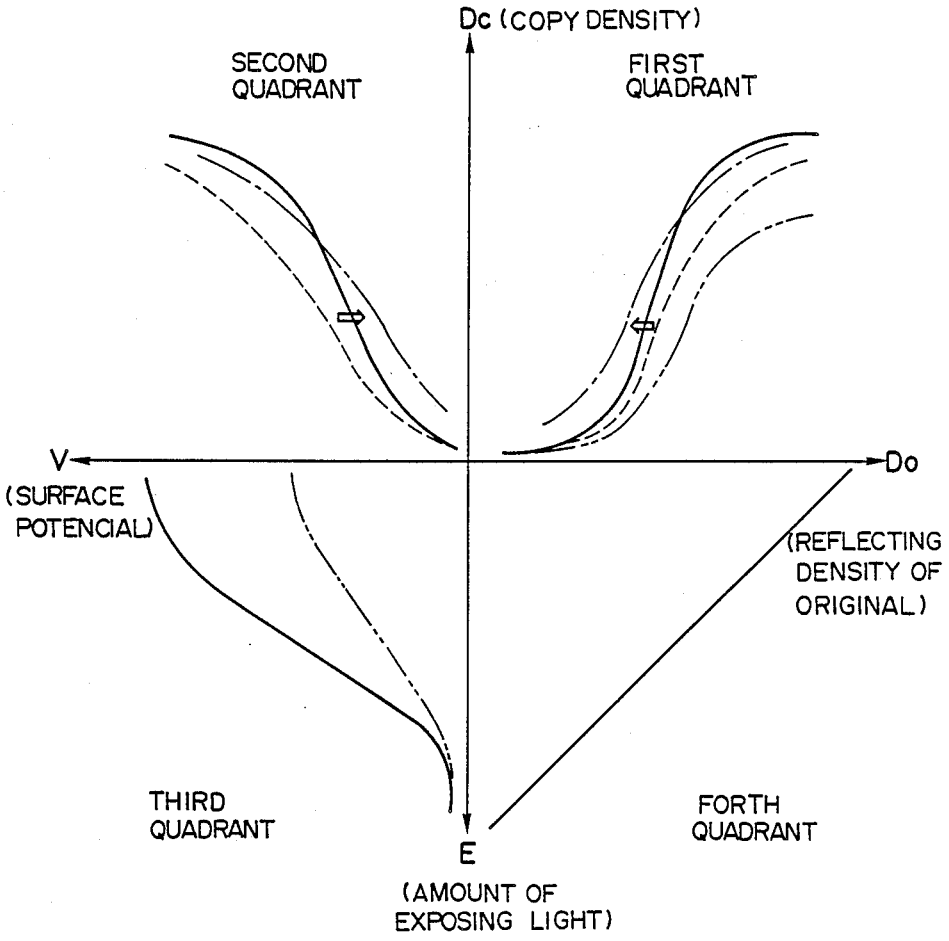
FIG. 9 is an explanatory diagram showing a sensitometry.

It is well known that the degree of fidelity in the reproduction when an original was copied can be expressed as a sensitometry. FIG. 9 shows such a sensitometry. The reflecting density ($D_c$) of the copy to the reflecting density ($D_o$) of an original is shown in the first quadrant in FIG. 9. This curve can be obtained by the following three characteristics: namely, the relation between the original reflecting density ($D_o$) and the amount (E) of exposing light which is irradiated onto the surface of a photo sensitive material (this relation is shown in the fourth quadrant); the relation between the amount (E) of exposing light and the potential (V) on the surface of the photo sensitive material (this relation is shown in the third quadrant); and the relation between the potential (V) and the copy reflecting density ($D_c$) (this relation is shown in the second quadrant). Therefore, by changing the characteristic curve of $D_o$–$D_c$ in the first quadrant, the gradation changes. This means that a desired $D_o$–$D_c$ curve can be obtained by changing one of or a combination of the characteristic curves in the respective quadrants.

For example, the case where the development characteristic (V - $D_c$) in the second quadrant was changed is shown. In general, the characteristic as shown by a solid line is obtained in each quadrant. However, in the first quadrant, this characteristic corresponds to the case where $\gamma$ is large, and it is suitable to reproduce a line. However, if an image was photographed under this condition, the copy image becomes hard and the details of the photograph are not reproduced. As a reproducibility of the gradation, it is ideal that the characteristic curve in the first quadrant has a gradient of 45°. However, as compared with the ideal curve, in the case of the curve shown by a solid line, $\gamma$ is large, particularly, in the low density portion and the low density portion of the photograph cannot be reproduced with a high fidelity.

Therefore, the development characteristic (V - $D_c$) expressed in the second quadrant is changed. In this case, a system which is known as a jumping development disclosed in U.S. Pat. Nos. 4,292,387, 4,395,476, etc. was used as a developing system. According to this developing system, the alternate current component AC which is derived by adding the direct current component DC to the development bias is used. The bias conditions in the case of the characteristic curve shown by the solid line are as follows. The peak to peak voltage of the AC was 1200$V_{pp}$, the frequency was 1500 Hz, and the DC component was 200V. When the AC component was set to 1000$V_{pp}$ and 800 Hz, the V - $D_c$ characteristic shown by a broken line was derived. At this time, the $D_o$–$D_c$ characteristic becomes as shown by the broken line. It will be understood that the Y characteristic was improved. Further, when the DC component of the bias was changed from 200V to 100V, the V - $D_c$ characteristic changes as indicated by an arrow (→), namely, becomes the characteristic as indicated by an alternate long and short dash line. The $D_o$–$D_c$ characteristic corresponding to that characteristic also becomes as shown by an alternate long and short dash line in the first quadrant. It will be understood that this characteristic curve approached the ideal straight line of 45°. In the actual image, it has been confirmed that the reproducibility of the middle density was fairly improved. Namely, $\gamma$ of the $D_o$–$D_c$ characteristic can be reduced by reducing the frequency of the AC component, reducing the peak to peak voltage $V_{pp}$ of the AC component, or reducing the voltage of the DC component.

The case where the development characteristic was changed has been shown in this example. Similarly, the latent image characteristic (E - V) shown in the third quadrant or the exposure characteristic (E - $D_o$) shown in the fourth quadrant can be also changed.

On the other hand, the gradation reproducibility can be further improved by a combination of the changes in those development, latent image, and exposure characteristics.

To further improve the development characteristic, not only the developing unit but also the characteristic of the toner can be also changed. For example, if a toner of particles which are finer than those in the ordinary toner is used to improve the reproducibility of a photograph, a fine image suitable for a photograph can be obtained.

The developing conditions of a single developing unit can be changed. A plurality of developing unit having different development characteristics can be used. Or, a combination of these methods can be also used.

As a method of changing the latent image characteristic, a method whereby a charging amount to the photo sensitive material (corresponding to the potential V on the surface of the photo sensitive material) in the E - V characteristic is changed is effective.

For example, as shown in the third quadrant in FIG. 9, $\gamma$ of the E - V characteristic decreases by changing the E - V characteristic (V=650V) indicated by a solid line to that shown by an alternate long and two short dashes line (V=340V), namely, by reducing the charging amount to the dark portion of the original from 650V to 340V. Thus, $\gamma$ of the $D_o$–$D_c$ characteristic (indicated by an alternate long and two short dashes line in the first quadrant) also decreases and the image having a good gradation can be obtained. To reduce the surface potential V, it is sufficient to reduce the charging voltage of a charging device 2.

As another method of changing the latent image characteristic, $\gamma$ of the E - V characteristic in the fourth quadrant in FIG. 9 is changed.

In the case of the E - V characteristic shown by the solid line in FIG. 9, the value of $\gamma$ is small in the portion where the amount of exposing light is relatively small, while $\gamma$ is large in the portion where the amount of exposing light is large. Accordingly, if the operator desires to emphasize the gradation than the present gradation, it is sufficient to reduce the amount of exposing light of an exposing lamp (not shown). However, in this case, since the amount of light is small, the blank portion of the image sometimes becomes fogging. However, by changing the developing bias (the DC component in the case of the jumping development) as necessary, the density can be adjusted to a proper value. In the following first embodiment, a system using two developing units having different $\gamma$ characteristics will be described.

Figure 1:
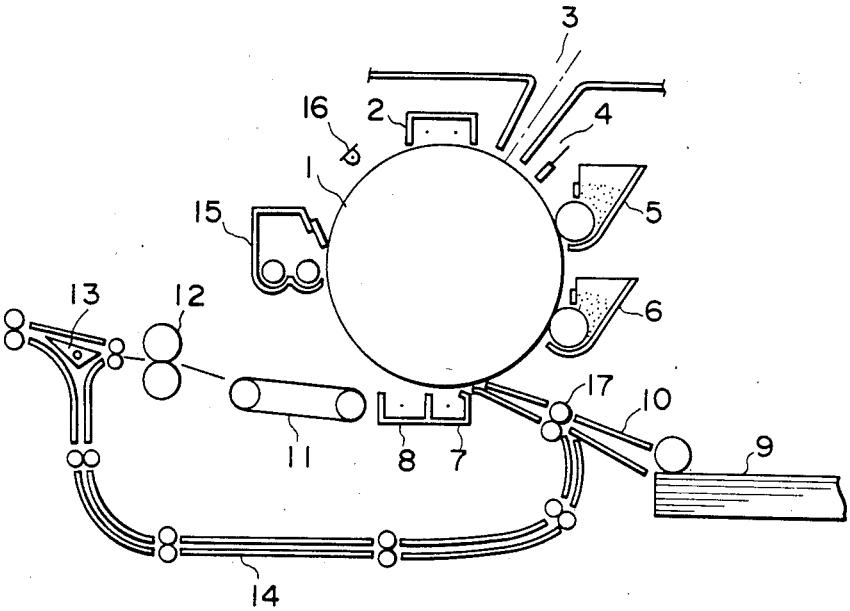
FIG. 1 is a diagrammatical cross sectional view of the first embodiment of the present invention.

FIG. 1 is a cross sectional view showing the first embodiment of the invention.

In the diagram, reference numeral 1 denotes a photo sensitive drum. After the drum 1 was uniformly charged by the charging device 2, an electrostatic latent image is formed on the drum surface in accordance with a light image 3 from an original. An LED array 4 is ordinarily used to erase the charges in the non-image portion (where no image is formed). The LED array 4 is also used to erase the charges in an arbitrary area of the original in this embodiment.

Figure 2:
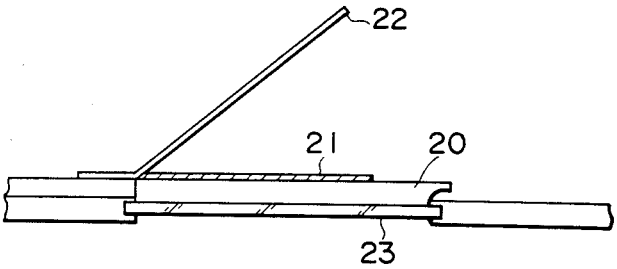
FIG. 2 is a diagrammatical cross sectional view when an original was put on an original pressing plate.
Figure 3:
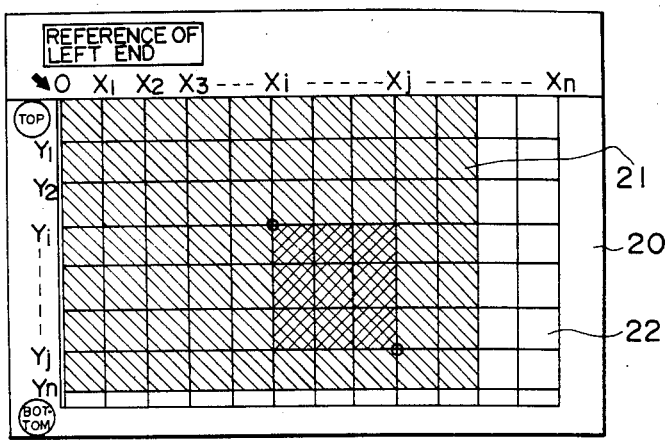
FIG. 3 is a diagrammatical view when the original pressing plate is looked down from above.

To designate an arbitrary area of the original, as shown in FIG. 2, an original 21 is set upside-up onto an original pressing plate 20. A lattice pattern sheet 22 is put on the original 21 set, thereby allowing the position of the original to be accurately known (FIG. 3). The original is set so that the left upper edge portion of the original coincides with the left upper edge portion of the sheet 22. In the diagram, the lattice pattern of the sheet 22 is displayed so that the left end is used as a reference position. A digitizer is embedded in the upper surface of the original pressing plate 20. By pressing two points ($X_i$, $Y_i$) and ($X_j$, $Y_j$) on a diagonal line in the portion which was area designated, the area having the diagonal line specified by these two points can be designated.

Figure 4:
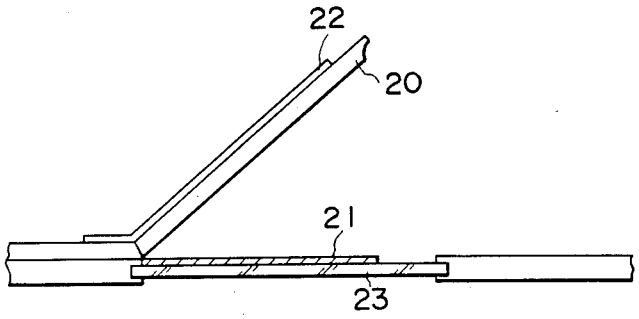
FIG. 4 is a diagrammatical cross sectional view when an original was put on an original glass base plate.
Figure 5:
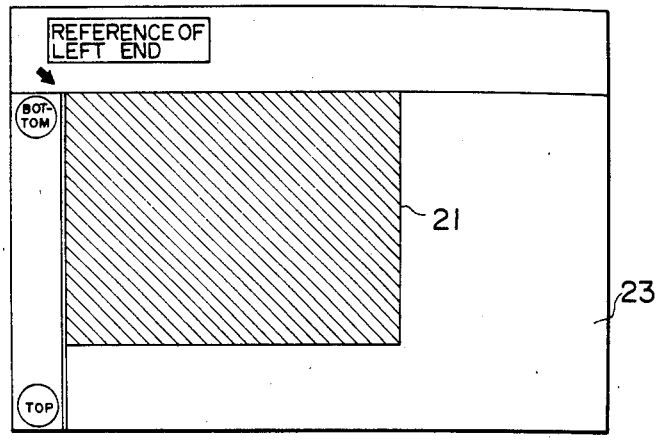
FIG. 5 is a diagrammatical view when an original was put on an original glass base plate and is looked down from above.

Although the area designated original 21 is then set onto an original base glass plate 23 as shown in FIG. 4, the front and back sides are reversed. As shown in FIG. 5, the original 21 is set onto the glass plate 23 in a manner such that the left upper edge of the original coincides with the left upper edge portion of the glass plate 23. In this diagram, the original is displayed so that the left end is used as a reference position. Therefore, the top and bottom of the original in the Y direction are reversed.

In this manner, the original 21 which was put on the original pressing plate 20 is set upside-down onto the original base glass plate 23 so that the left end of the original 21 is used as a reference position. Thus, the values which were read by the digitizer are the same as the position in the X direction of the actual original 21 on the glass plate 23 but are opposite to the position in the Y direction of the original 21.

Figure 6:
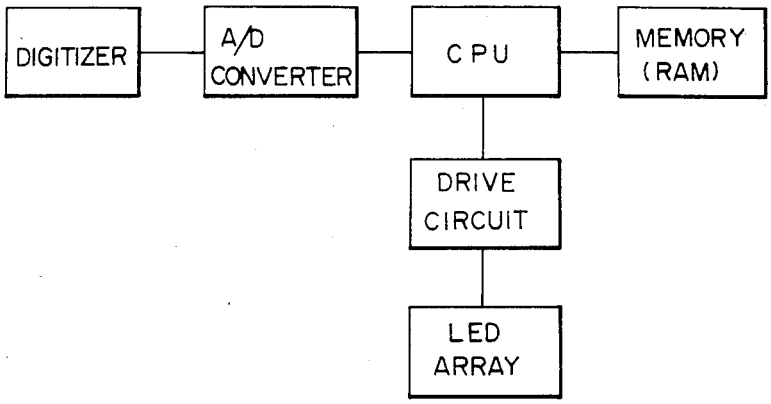
FIG. 6 is a block diagram showing the control of an LED array when using a digitizer.

The coordinates designated by the digitizer are A/D converted into the digital values as shown in FIG. 6. The digital values are input to a CPU and arithmetically operated and stored into a memory (RAM). An output signal processed by the CPU is input to a drive circuit, thereby controlling the light-on and light-off of the LED array.

The light-on/off operations of the LED array in the original scanning direction (X direction) are controlled by the timing of the position of $X_i$ and by the time interval from $X_i$ to $X_j$. The light-on/off operations of the LED array in the direction (Y direction) perpendicular to the original scanning direction are controlled on the basis of the number of LEDs which are lit on. Since the position of the original on the digitizer is opposite to the position on the original on the original base glass plate with respect to the Y direction, this correcting process is also executed by the CPU.

The electrostatic latent image which was obtained by erasing an arbitrary area of the original functions to develop the non-erased area by a first developing unit (developing unit for a photograph) 5. Next, at the position of a second developing unit 6, the second developing unit 6 is moved away from the photo sensitive drum 1 to prevent that the development is performed by the second developing unit 6. Or, means for applying such a bias as to prevent the development with the second developing device 6 kept in contact with the drum 1 or other means is used. The image which was visually formed by the developing apparatus in which the value of $\gamma$ is small for use as a photograph is electrostatically transferred by a transfer charging device 7 onto a paper 9 which was conveyed via a paper feed guide 10. Further, the paper is separated from the drum 1 by a separate discharging device 8 and conveyed by conveying means 11 and the image on the paper is fixed by a fixing device 12. The paper having the fixed image is returned to a position near the paper feed guide 10 through a conveying path 14 for a multi-copy by switching means 13.

The residual toner on the photo sensitive drum 1 after the image was transferred and separated is eliminated by cleaning means 15. The potential on the drum is made uniform by discharging lamp 16 and thereafter, the next operating cycle follows. An electrostatic latent image according to the light image 3 from the original is formed on the drum 1 which was uniformly charged by the charging device 2 in a manner similar to the preceding cycle. However, in this case, the area which was erased by the LED array 4 in the preceding cycle is not erased. On the contrary, the area which was not erased in the preceding cycle (in this case, the area to be erased and the area which is not erased can be newly designated) is erased.

The area which was designated in the preceding cycle is stored in the memory (RAM). In the present cycle, the designated area is accessed from the memory (RAM) by the CPU and arithmetically operated. The light-on t imings of the LEDs and the number of LEDs which are lit on are controlled in a manner such that the original scanning direction and the LEDs which are lit on are completely opposite to those in the preceding cycle.

The image in the area which was not erased in the present cycle is developed by the second developing unit (for a line) 6. However, since it is not developed at the position of the first developing unit 5, the first developing unit 5 is moved away from the drum 1 or such a bias that the development is not performed with the first developing unit 5 held in contact with the drum 1 is applied in a manner similar to the case of the second developing unit 6 in the preceding cycle. The paper having the image which was visually formed by the developing appaaatus in which the value of $\gamma$ is large for use of a line is electrostatically transferred by the transfer charging device 7 onto the copy paper which was developed by the first developing unit 5 in the preceding cycle and was conveyed at the timing by a resist roller 17 in accordance with the position of the image on the drum. The paper having the transferred image is separated from the drum 1 by the separate discharging device 8. Thereafter, the paper is conveyed by the conveying means 11 and is fixed by the fixing device 12 and then ejected out of the copying machine by the switching means 13. Thus, the copy in which the line portion and the photograph portion are synthesized is completed.

Figures 7, 7A:
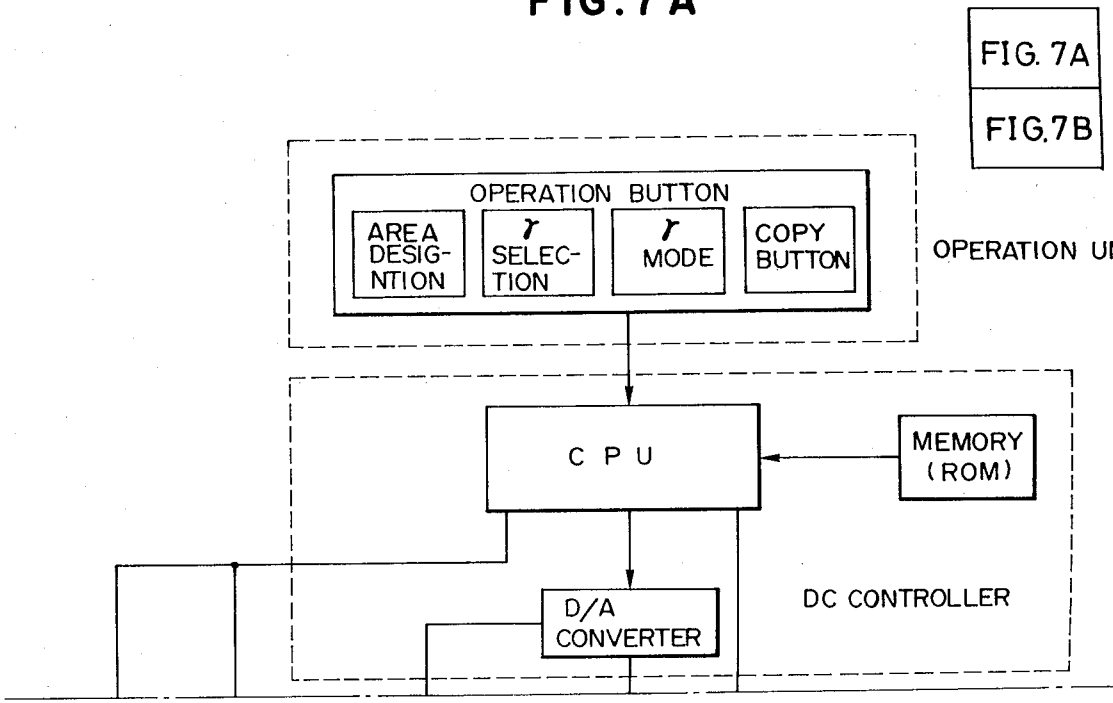
FIG. 7, consisting of FIGS. 7A and 7B, is a block diagram showing the operation of a developing unit.
Figure 7B:
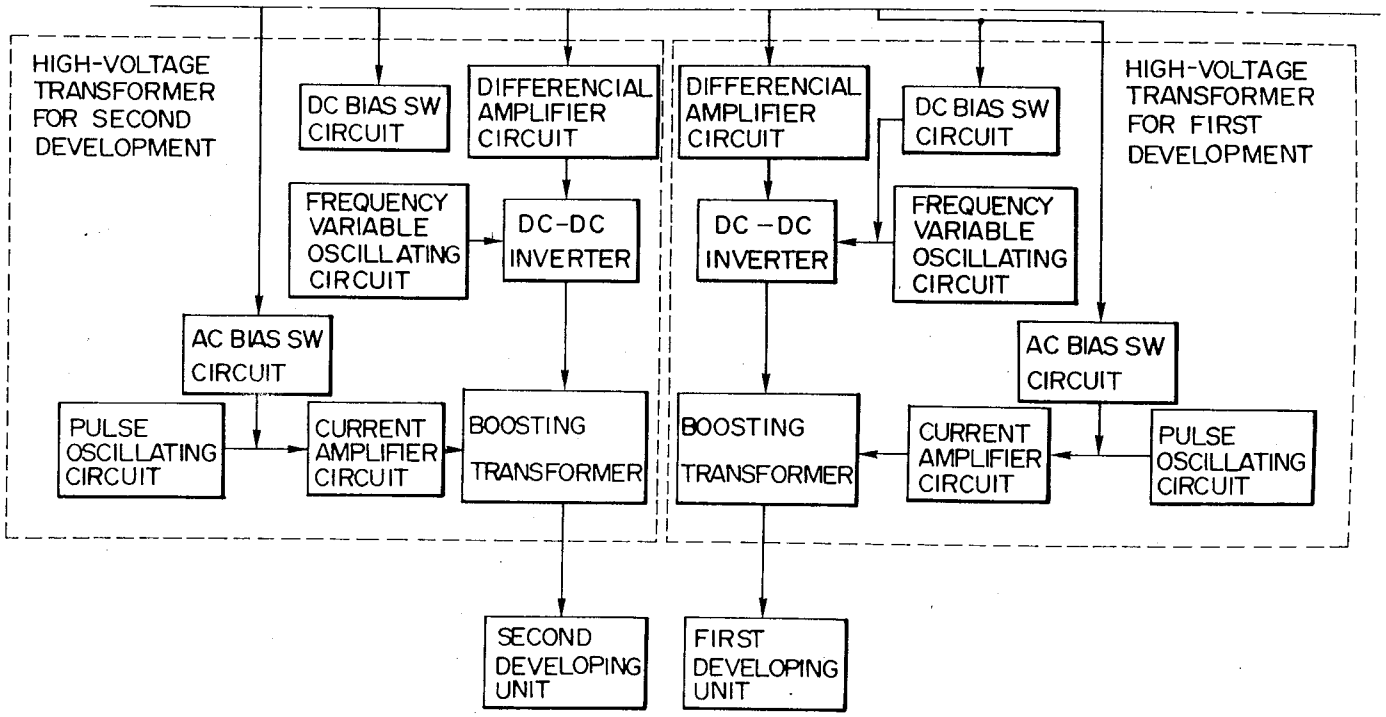

The operation of the developing unit in the automatic synthesis copying mode will now be explained with reference to FIG. 7.

In general, when using the overlap development, the developing unit in the inoperative mode is moved away from the photo sensitive drum by a plunger, eccentric cam, or the like. Or, spikes of a developing agent on a developing cylinder are mechanically cut or other mechanical method is used.

On the other hand, in the jumping development, as compared with the magnetic brushes of two components, since the developing agent is not come into contact with the photo sensitive drum, there is also a case where it is sufficient to apply only a developing bias.

After the area designation mode, $\gamma$ selection mode, and $\gamma$ mode were selected by the operation buttons, when a copy button is pressed, the copying machine operates in the automatic synthesis copying mode by the CPU.

An explanation will now be made with respect to the operation when an output of a high voltage transformer for the first development is applied to the first developing unit 5 in the case where an arbitrary area of a photograph is copied by the first developing unit 5.

When a set value of a density adjusting volume (not shown) is input to the CPU and arithmetically operated, a DC bias control signal is input to the high voltage transformer for the first development through a D/A converter. This control signal is input to a differential amplifier. An output of the differential amplifier is input to a DC-DC inverter to which an output from a frequency variable oscillating circuit is supplied. Pulses generated from a pulse oscillating circuit are current amplified and boosted by a boosting transformer, so that the boosted AC component is obtained. An output of the DC-DC inverter is added to the boosted AC component in the boosting transformer. An output of the boosting transformer is applied to first developing unit. At this time, a DC bias SW circuit and an AC bias SW circuit of the high voltage transformer for the first development are switched so as to generate the DC and AC high voltages. In response to the signal of the CPU, the AC output of the high voltage transformer for the second development is turned off and only the DC high voltage output is turned on by the DC bias SW circuit. The voltage of the high voltage transformer for the second development is set to such a value that the toner for the first development is not developed from the developing unit onto the drum.

For the AC bias of the first developing unit, the peak to peak voltage $V_{pp}$ is set to 1000V and the frequency is set to 800 Hz. The DC component is set to 100V at the reference density. Therefore, the characteristics in which the value of $\gamma$ is small as shown by the alternate long and short dash lines in the first and second quadrants in FIG. 9 are derived. Thus, the image such as a photograph image having gradations is reproduced with a high fidelity. Further, by changing the DC component of the developing bias by use of the density adjusting volume, the density can be also varied.

Next, in the second-time copy for a diagram which was stored in the ROM, in a manner which is completely opposite to the case of the photograph copy, the high voltage transformer for the second development is controlled so that the DC and AC components are turned on in a manner similar to the foregoing case of the first development. On the contrary, the high voltage transformer for the first development is controlled such that the AC high voltage component is turned off and the DC high voltage component is set to such a voltage that the first developing toner is not developed onto the drum from the developing unit.

For the AC bias of the second developing unit, the $V_{pp}$ is set to 1200V and the frequency is set to 1500 Hz. The DC component is set to 200V at the reference density. Therefore, the characteristics in which the value of $\gamma$ is large as shown by the solid lines in the first and second quadrants in FIG. 9 are derived. Thus, the diagram is reproduced with a high fidelity. On the other hand, similarly to the first developing unit, by changing the DC component of the developing bias by use of the density adjusting volume, the density can be varied.

An area has been designated by the digitizer in this embodiment. However, the invention is not limited to this method. An area can be also key-input by reading the coordinates of the original.

Figure 8:
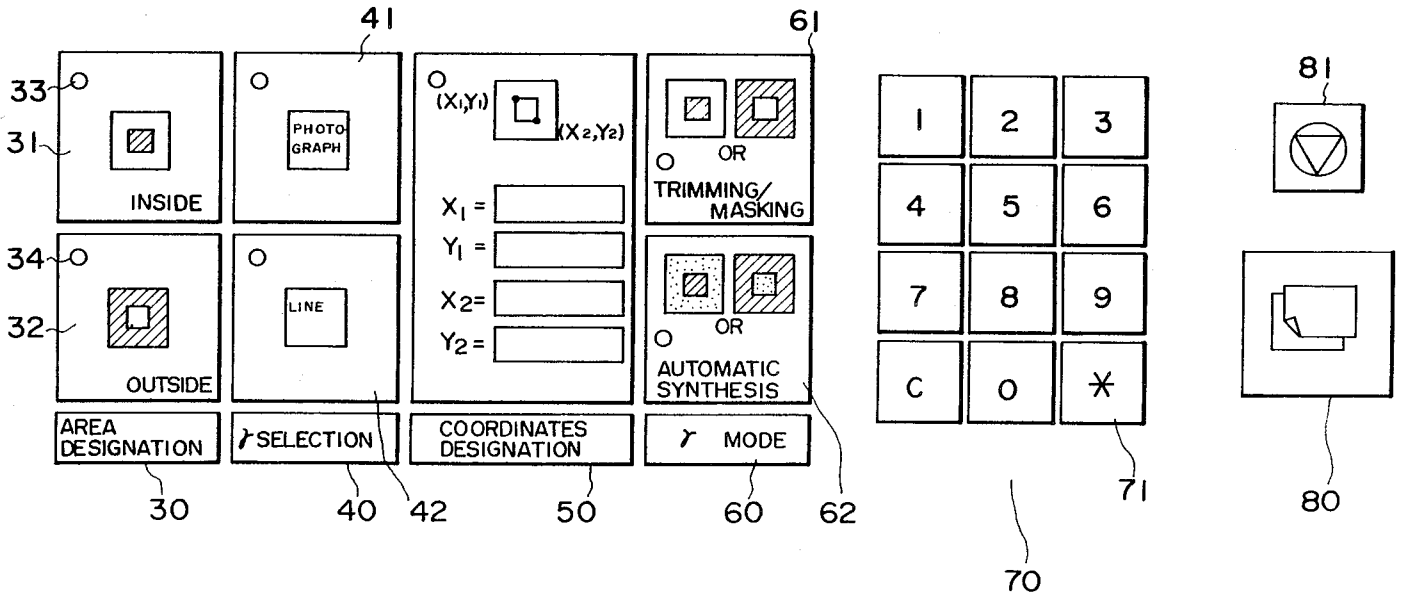
FIG. 8 is an explanatory diagram of an operation unit to designate an area by a key input.

An operating method for the area designation automatic synthesis copy by the key-input will now be explained with reference to FIG. 8.

First, an inside 31 or an outside 32 of the designated area is designated by pressing an area designation button 30. Numerals 33 and 34 denote LEDs. When either the inside 31 or the outside 32 is selected by the area designation button 30, the LED 33 or 34 is lit on to thereby indicate that the inside or the outside has been designated. Next, by pressing a $\gamma$ selection button 40, $\gamma$ of the designated area is selected. For example, when the inside of the designated area is set into the copy for a photograph, the inside 31 is selected by the area designation button 30 and a photograph 41 is selected by the $\gamma$ selection button 40. Next, the coordinates of the designated area are designated by inputting two points on the diagonal line of a rectangular area by a keyboard 70. In this case, after an input key 71 was pressed, the coordinates $(X_1, Y_1)$ and $(X_2, Y_2)$ are input. Each time one coordinate has been input and after all of the coordinates were input, the input key 71 is pressed, thereby distinguishing the coordinates input operation from the display of the number of copy sheets. For example, assuming that $X_1=10$, $Y_1=5$, $X_2=20$, and $Y_2=15$, the keyboard 70 is operated by pressing the keys as follows.

[*] [1] [0] [*] [5] [*] [2] [0] [*] [1] [5] [*]

Next, either one of the two methods is selected: namely, a method whereby only the designated area is copied (61) by the selected $\gamma$ by pressing a Y mode selection button 60; and a method for an automatic synthesis copy (62) whereby the designated area is copied by the selected $\gamma$ and the other area is copied by the other non-selected $\gamma$ (e.g., line mode).

After the area designation, $\gamma$ selection, coordinate designation, and $\gamma$ mode were selected as described above, a copy button 80 is pressed to start the copying operation.

There is another method whereby the respective display panels 61 and 62 are also directly used as copy buttons without providing the $\gamma$ mode selection button 60.

Although one rectangular area has been designated in this embodiment, it is also possible to designate two or more areas or an area of a complicated shape if the capabilities of the digitizer and CPU and the memory capacity are sufficient. On the other hand, by use of a CCD, an area written on an original can be also designated.

On the other hand, the developing units have been used to copy for line and photograph in the foregoing embodiment. However, variable adjusting means for continuously changing $\gamma$ can be also provided. The invention can be also applied to the case where three or more developing units are used.

Further, if the development characteristics are switched every time, it is sufficient to use one developing unit. For the development characteristics, there is no need to change all of the voltage and frequency of the AC component and the voltage of the DC component but only a part of them can be also changed.

In addition, although the LED array has been used as the charge erasing means, other means such as a liquid crystal shutter array or the like can be also used.

An area can be also determined by previously discriminating whether the copy mode is the photograph mode or the line mode. This discrimination can be performed from a level distribution of a histogram of an output of the CCD corresponding to one page of an original.

As described above, for an original such that photographs and characters mixedly exist, a copy image which satisfies both of the photographs and the characters can be obtained by simple operations.

The foregoing first embodiment relates to the example in which areas having different kinds of characteristics of an original are manually set.

The second embodiment will now be explained with regard to an example in which areas of different kinds of characteristics are automatically discriminated and processed.

Figure 10:
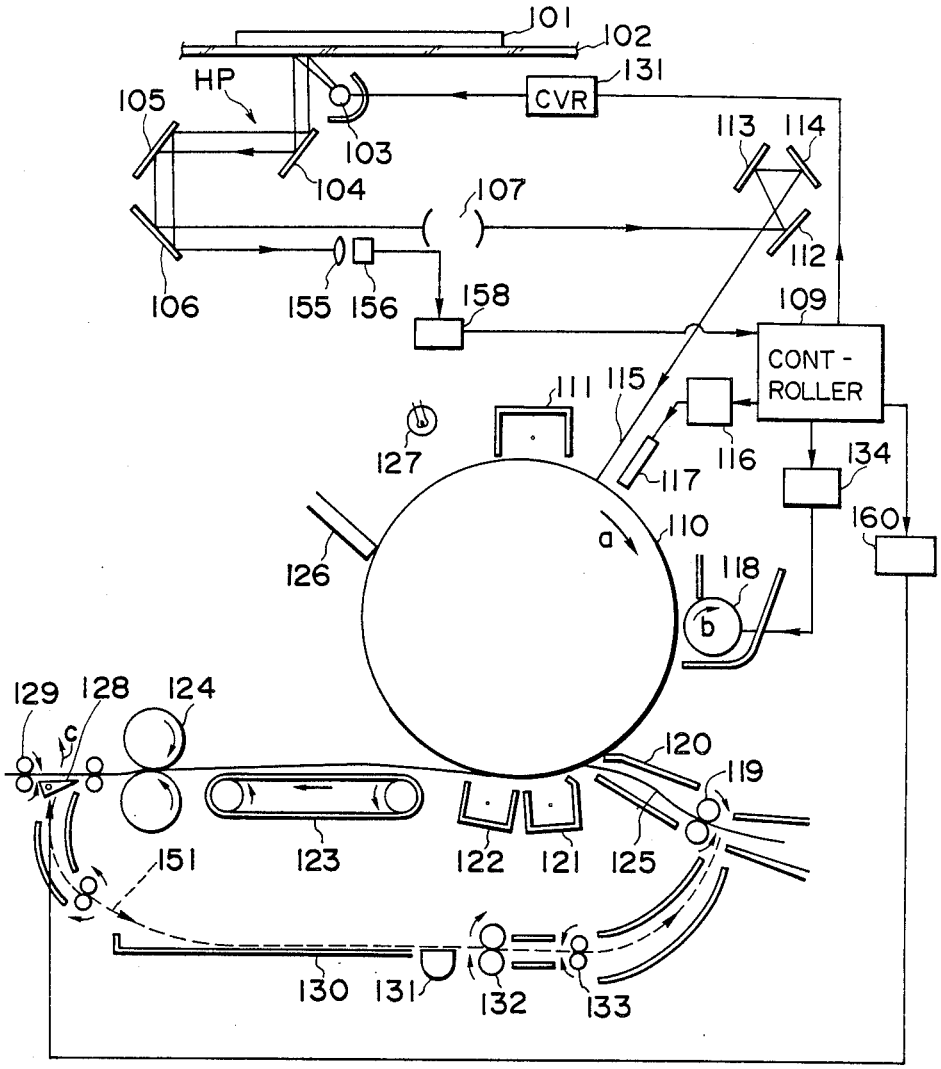
FIG. 10 is a schematic diagram of the second embodiment of the invention.
Figure 11:
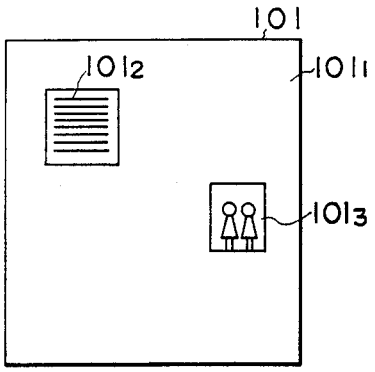
FIG. 11 is a diagram showing an original in which the portions having different kinds of characteristics mixedly exist.
Figure 12:
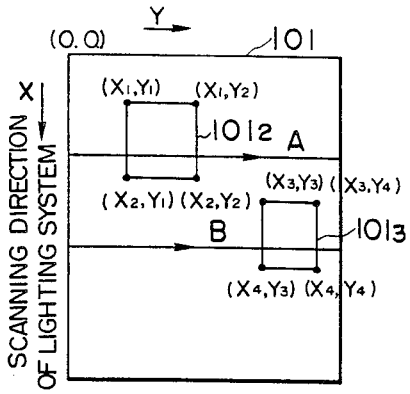
FIG. 12 is a diagram showing the coordinates of each point of the original.
Figure 13:
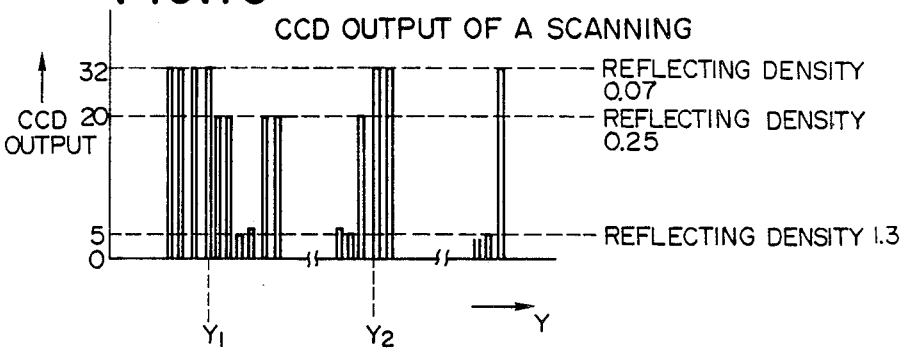
FIG. 13 is a diagram showing a CCD output of the A scanning.
Figure 14:
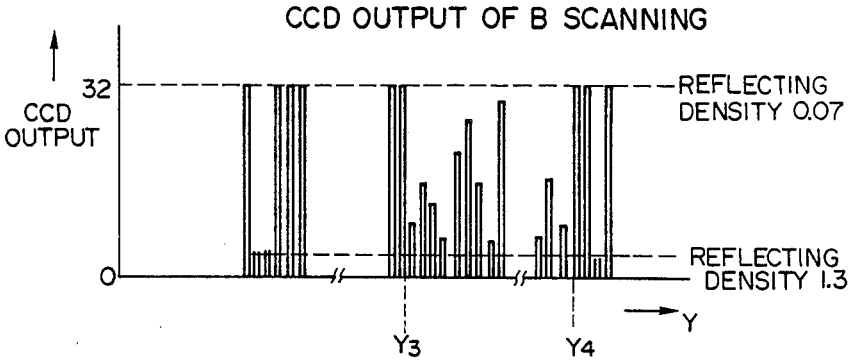
FIG. 14 is a diagram showing a CCD output of the B scanning.

FIG. 10 is a schematic diagram of the second embodiment of the invention. A reference original $\mathbf{101}_1$ having a low background density (reflecting density of the background portion is 0.07) as shown in FIG. 11 is used as a reference. A newspaper original $\mathbf{101}_2$ having a high background density (reflecting density of the background portion is 0.25) and a photograph original $\mathbf{101}_3$ having a wide gradation range (an image having continuous gradations such that the reflecting density lies within a range from 0.2 to 1.3) mixedly exist in an original 101. The user puts on the original 101 onto an original setting base 102 and presses a copy button on an operation unit (not shown). Thus, prior to executing the copying operation, a halogen lamp 103 and a first mirror 104 scan the original 101 at a speed of $v_1$ mm/sec. A second mirror 105 and a third mirror 106 scan the original 101 at a speed of $v_1/2$ mm/sec. In this manner, the original is detected and areas are discriminated. The lamp 103 and the first to third mirrors 104 to 106 are forwardly moved from a position HP and then returned to the position HP, thereby finishing a single scanning operation. The rated values of the halogen lamp 103 are 80V and 200 W. When the original is detected and areas are discriminated, the lamp 103 is lit on at a voltage of about 60V and the original information is input to a CCD 156 through a reducing lens 155. The CCD 156 is disposed at the position such as not to disturb the image exposing light which is input to a lens 107. The original information which was input to the CCD 156 is supplied to a DC controller 109 through the A/D converter 158. The original information is sampled every 1 mm in the direction perpendicular to the scanning direction of the lighting system. In the A scan in FIG. 12, a histogram as shown in FIG. 13 is formed by the DC controller 109. In the B scan in FIG. 12, a histogram as shown in FIG. 14 is formed by the DC controller 109. As shown in FIG. 13, the output value of the CCD is 32 in the case of the reflecting density of 0.07 of the background portion of the reference original $\mathbf{101}_1$, while the output value of the CCD is 20 in the case of the reflecting density of 0.25 of the background portion of the newspaper original $\mathbf{101}_2$. There is a large difference between them. Therefore, it is possible to decide that the area between $Y_1$ and $Y_2$ of the Y coordinates is the original in which the background portion is dark.

The CCD output value is the digital value which is obtained by dividing the reflecting density range from 0.07 to 1.4 into 32 levels. For example, there are the following corresponding relations between the reflecting density and the CCD output value.

| <Reflecting density> | <CCD output value> |
|---|---|
| 0.07 | 32 |
| 0.25 | 20 |
| 1.3 | 5 |

The original information is also sampled every 1 mm in the scanning direction of the lighting system. In the X direction of the original, histograms are also formed similarly to the case of the Y direction in FIG. 13. Thus, the area between $X_1$ and $X_2$ of the X coordinates can be detected as the original having the dark background portion.

The areas of the photograph original $\mathbf{101}_3$ and reference original $\mathbf{101}_1$ are detected in the following manner. Namely, in the Y direction, as shown in FIG. 14, the reflecting density lies within a wide range from 0.2 to 1.3 in the case of the photograph original, so that the CCD output value also has dispersive values. Therefore, the function such that when the CCD output value has dispersive values in a certain area, it is determined that the original is the photograph original is provided for the DC controller 109. Due to this, the area between $Y_3$ and $Y_4$ of the Y coordinates can be detected as a photograph original.

In the X dieection, the area between $X_3$ and $X_4$ of the X coordinates can be also similarly detected as a photograph original.

After completion of the foregoing detecting process, the optical system is returned. When the position of the HP is detected, the exposure and scan are restarted and the copying process is executed three times in the multicopy mode. In the first copying process, an OPC photo sensitive material 110 having a diameter $\phi$ of 108 mm which is rotating in the a direction at a peripheral speed of $v_1$ mm/sec is primary charged by a primary charging device 111 so that the dark portion potential $V_D$ of $-650$V is held on the photo sensitive material 110. The halogen lamp 103 and the first to third mirrors 104 to 106 operate under the same conditions as those in the original detecting process. The lamp voltage is set to 60V. An image exposing light 115 is irradiated onto the OPC photo sensitive material 110 through a fourth mirror 112, a fifth mirror 113, and a sixth mirror 114 which are fixed. Thus, an electrostatic latent image of the light portion potential $V_L = -170$V is formed. However, the electrostatic latent images formed in the area $\mathbf{101}_2$ corresponding to the newspaper original which is surrounded by the coordinates $(X_1, Y_1)$, $(X_1, Y_2)$, $(X_2, Y_1)$, and $(X_2, Y_2)$ and in the area $\mathbf{101}_3$ corresponding to the photograph original which is surrounded by the coordinates $(X_3, Y_3)$, $(X_3, Y_4)$, $(X_4, Y_3)$, and $(X_4, Y_4)$ are erased by controlling the timings to light on the LEDs of a blank exposing light (LED array) 117 by a blank exposure control circuit 116. Next, the area consisting of only the reference original $\mathbf{101}_1$ excluding the areas corresponding to the newspaper original $\mathbf{101}_2$ and photograph original $\mathbf{101}_3$ is developed as a visible image by a developing sleeve 118. The sleeve 118 rotates in the b direction at a peripheral speed of $v_1$ mm/sec and is applied with the peak to peak voltage of $1400V_{pp}$ at 2000 Hz as a sine wave to which the DC component of $-220$V was applied. A transfer sheet 125 is then fed by a first resist roller 119 at the transfer timing controlled thereby and passes through a transfer guide 120. The toner image on the photo sensitive material 110 is transferred onto the transfer sheet 125 by a transfer charging device 121. Thereafter, the transfer sheet 125 is separated from the photo sensitive material 110 by a separate discharging device 122 and conveyed to a fixing device 124 by a conveying belt 123. The residual transfer toner on the photo sensitive material 110 is collected by a cleaner 126. Then, the copy memory on the photo sensitive material 110 is erased by a pre-exposing lamp 127. In the case of a single-copy mode, the transfer sheet 125 conveyed by the fixing device 124 passes through over a flapper 128 and is ejected out of the copying machine by discharging rollers 129. In the multi-copy mode, the flapper 128 is lifted up in the direction indicated by an arrow C and the transfer sheet 125 passes along a path as indicated by a broken line 151 and is enclosed onto a middle tray 130.

Figure 15:
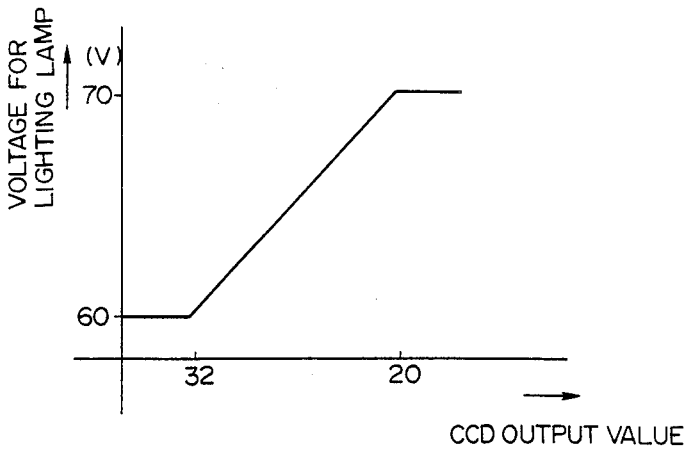
FIG. 15 is a diagram showing the relation between the CCD output value and the proper voltage for lighting a lamp.

After the first exposing scan had been finished, when the optical system was returned and the HP position was detected, the scan in the second copying process is started and only the area corresponding to the newspaper original is copied. The optimum voltage to light on the lamp 103 is determined in accordance with the relation shown in FIG. 15 on the basis of the CCD output value corresponding to the background portion of the newspaper which was obtained by the original detecting process which had been first performed. Namely, in the case of the background reflecting density of 0.07 of the reference original, the CCD output value is 32. The light-on voltage of the lamp 103 is 60V at this time and the image without fogging is derived. In the case of the background reflecting density of 0.25 such as in a newspaper original, the CCD output value is 20. At this time, by setting the light-on voltage of the lamp 103 to 70V, the image without fogging is derived. Therefore, the light-on voltage of the lamp 103 in the second copying operation is set to 70V by the DC controller 109 through a constant voltage regulator (CVR) 131. After the electrostatic latent image was formed at this voltage, by lighting on the blank exposing LED array 117, the electrostatic latent images in the areas other than the newspaper original area are erased.

Figure 16:
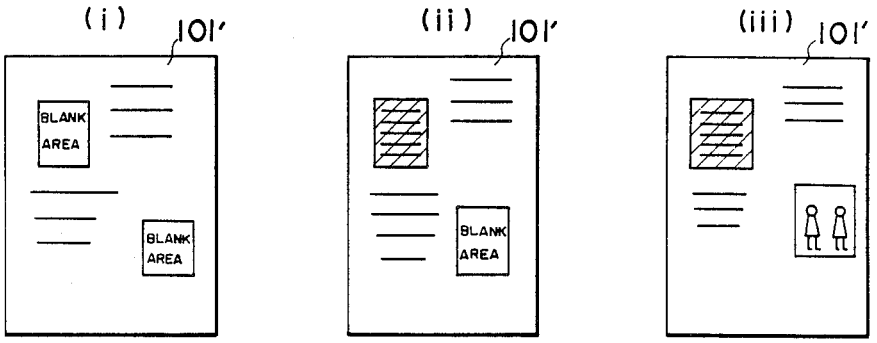
FIG. 16 is a diagram showing image states in the multiple mode.

The electrostatic latent image of only the newspaper original area is developed by the developing sleeve 118 under the same conditions as those in the first copying mode. The transfer sheet 125 enclosed on the middle tray 130 is picked up and fed by paper feed rollers 131 and passes through separate rollers 132. The transfer sheet 125 is then conveyed to the first resist rollers 119 by second resist rollers 133 at the timing controlled thereby. In the first copying process, the newspaper original area and photograph original area on the transfer sheet 125 are the blank areas as shown in FIG. 16(i). However, in the second transfer process, the toner image is transferred to the area corresponding to the newspaper original. Thereafter, the transfer sheet is enclosed onto the middle tray 130 in the state as shown in FIG. 16(ii) under the same conditions as those in the first copying process.

Next, in the third copying process, the image in only the area corresponding to the photograph original is copied. After the electrostatic latent image was formed under to same conditions (the light-on voltage of the lamp 103 is set to 60V) as those in the first copying process, by lighting on the blank exposure LED array 117, the electrostatic latent images other than the portion corresponding to the photograph original area are erased. To improve the reproducibility of the half tone, the development conditions are set as follows. Namely, the developing bias conditions are set such that the AC sine wave of $V_{pp}=1000V$ and $V_f=400$ Hz is used and the DC component of $-320V$ is applied to the developing sleeve 118 through a high voltage transformer 134.

Figure 17:
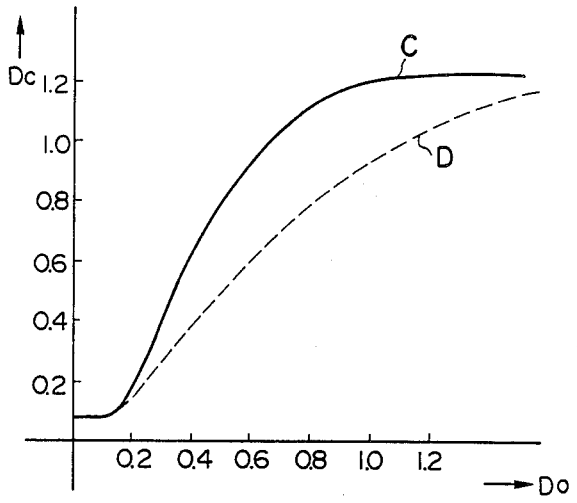
FIG. 17 is a diagram showing the D—D characteristics when a reference original and a photograph original are used.

FIG. 17 shows $D_o$-$D_c$ characteristic curves. C denotes the curve under the developing bias conditions in the case of the reference original. D indicates the curve under the developing bias conditions in the case of the photograph original. It will be understood that the gradation reproducibility is fairly improved in the case of the photograph original. The electrostatic latent image corresponding to the photograph original developed under the developing bias conditions is developed as a visible image and transferred onto the transfer sheet 125 in the state as shown in FIG. 16(iii). Thereafter, the flapper 128 is put down in the direction opposite to the arrow C. The transfer sheet 125 then passes through the discharging rollers 129. The copying operation is completed in this manner. The operation of the flapper 128 is controlled by the DC controller 109 and a flapper drive circuit 160.

Figures 18, 18A, 18B:
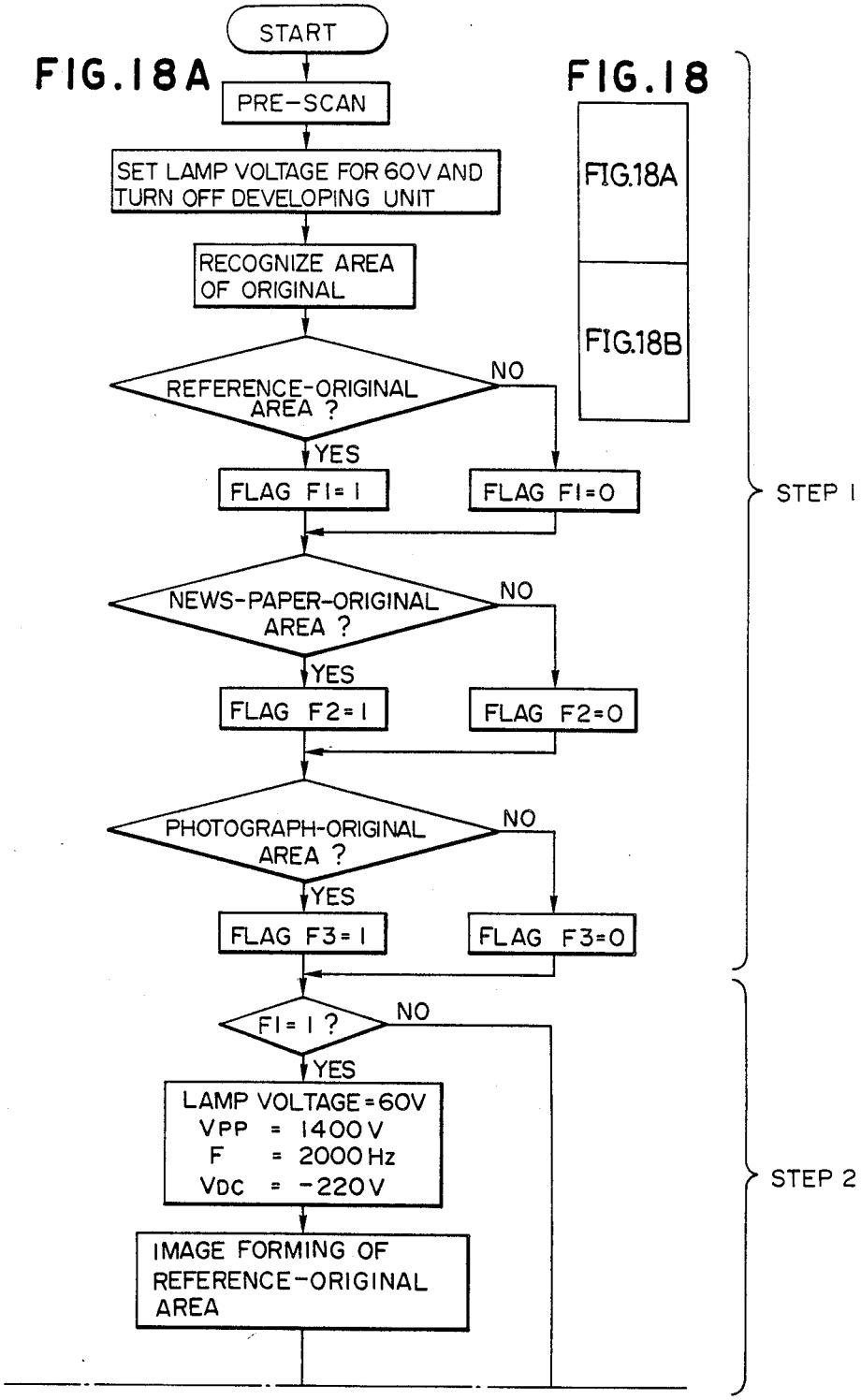
Figure 18B:
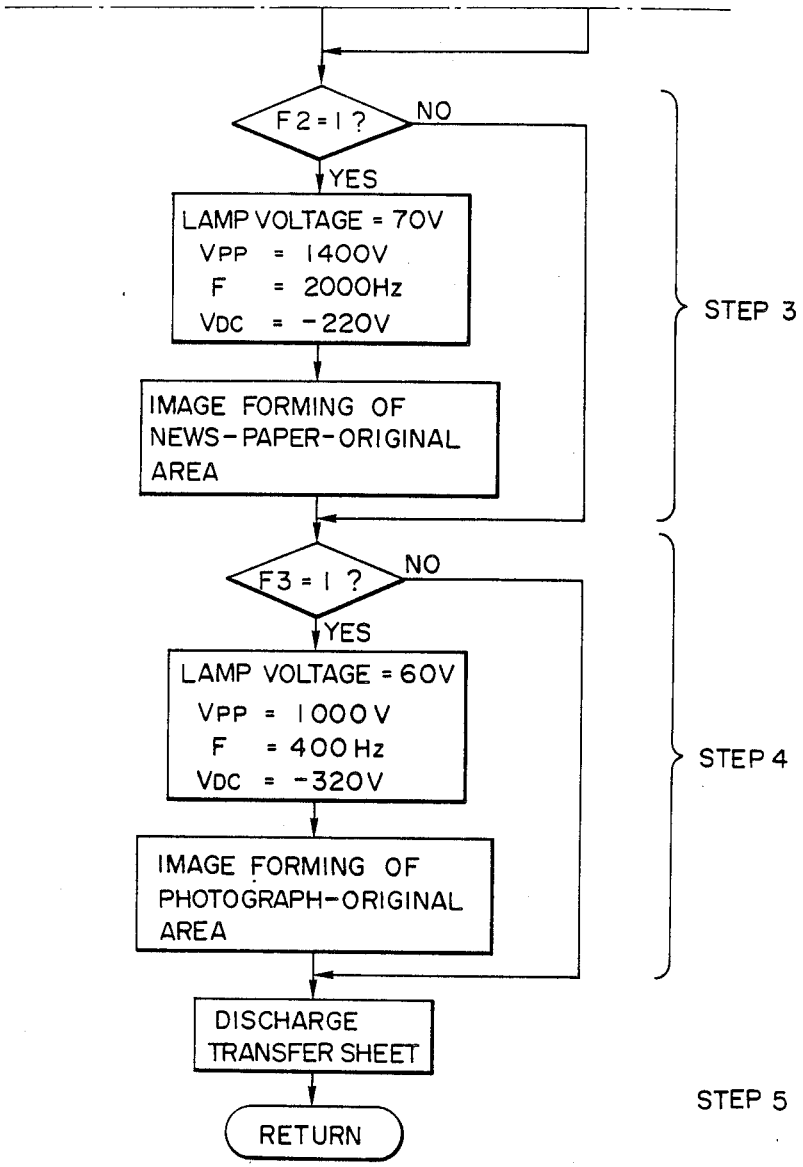

FIGS. 18A and 18B show control flowcharts for the DC controller 109 to explain the area discriminating operation and the image forming operation.

Step 1 relates to a flowchart for area discrimination. The pre-scan is performed. If a reference original area exists, a flag $F_1$ is set to 1. If a newspaper original area exists, a flag $F_2$ is set to 1. If a photograph original area exists, a flag $F_3$ is set to 1.

If all of the flags $F_1$, $F_2$, and $F_3$ have been set to 1, the foregoing three image forming processes are executed in steps 2 to 4 and the recorded paper is ejected out of the copying machine by the flapper 128 in step 5.

On the other hand, if the original consists of only the reference original areas, only the flag $F_1$ is set to 1. Therefore, the processes in only step 2 are executed and the recorded paper is then ejected out.

Similarly, if the original consists of only the newspaper original areas or photograph original areas, only the flag $F_2$ or $F_3$ is set to 1. The processes in only step 3 or 4 are executed and thereafter, the recorded paper is ejected out.

In the case of the original in which two of the foregoing three kinds of original areas exist, the corresponding two of the three flags $F_1$ to $F_3$ are set and the processes in the corresponding two of the steps 2 to 4 are executed. Thereafter, the recorded paper is ejected out. In this way, only the necessary processes are executed and the multiple copy image can be derived.

In this embodiment, the means for varying the lamp light-on voltage has been used as image forming means for the original having a dark background portion. However, means for varying the DC component of the developing bias can be also used. Or, a combination of these two types can be also used.

On the other hand, means for varying the developing bias has been used as image forming means for the photograph original in the foregoing embodiment. However, as described in FIG. 9, it is also possible to use means for reducing the value of the dark portion potential, $V_D$, for example, means for reducing the charging voltage of the charging device 111 or means for decreasing an amount of exposing light. Not only the V - $C_o$ characteristic but also the E - V characteristic or the $D_o$ - E characteristic can be changed, or these three kinds of characteristics can be also changed.

As described above, the original areas of different kinds of characteristics are automatically detected without designating the original areas and without selecting the image forming means by the user before the copying operation is performed. Even if various kinds of originals mixedly exist in one original, the optimum copy image can be obtained.

The present invention is not limited to the foregoing embodiments but many modifications and variations are possible within the spirit and scope of the appended claims of the invention.

We claim:

1. A multiple image forming system comprising:
latent image forming means for projecting a reflected light from an original onto a photo sensitive material and forming an electrostatic latent image onto said photo sensitive material;
developing means for developing said latent image; and
control means for making said latent image forming means and said developing means operative a plurality of times in order to reproduce every gradation characteristic for the different gradation characteristic areas in said original,
wherein said control means changes latent image forming conditions of the latent image forming means or developing conditions of said developing means in accordance with the kind of said gradation characteristic.

2. A system according to claim 1, further having erasing means for erasing the latent image in the area having the different kind of gradation characteristic.

3. A system according to claim 1, wherein said control means changes a developing bias of said developing means every gradation characteristic.

4. A system according to claim 1, wherein said control means changes an amount of exposing light of said latent image forming means to the original every reproducing characteristic.

5. A system according to claim 1, wherein said latent image forming means has charging means for charging the photo sensitive material, and said control means changes a charging amount of said charging means every gradation characteristic.

6. A system according to claim 1, wherein one of said gradation characteristics is a diagram.

7. A system according to claim 1, wherein one of said gradation characteristics has a wide continuous gradation range.

8. A system according to claim 1, wherein one of said gradation characteristics has a predetermined background density.

9. A system according to claim 1, further having designating means for manually designating said gradation characteristic area in the original, and wherein said control means controls said latent image forming means and said developing means in response to the area designated by said designating means.

10. A system according to claim 1, further having a recognizing means for automatically recognizing said gradation characteristic area in the original, and wherein said control means controls said latent image forming means and said developing means in accordance with the result of the area discrimination by said recognizing means.

11. A multiple image forming system comprising:
latent image forming means for projecting a reflected light from an original onto a photo sensitive material and forming an electrostatic latent image onto said photo sensitive material;
developing means for developing said latent image;
designating means for manually designating an area in the original every gradation characteristic;
control means for controlling a latent image forming characteristic of the latent image forming means or a developing characteristic of said developing means every area designated by said designating means; and
synthesizing means for synthesizing an image formed every said gradation characteristic.

12. A system according to claim 11, further having erasing means for erasing the latent image in the area having the different kind of gradation characteristic.

13. A system according to claim 11, wherein said control means changes a developing bias of said developing means every gradation characteristic.

14. A system according to claim 11, wherein said control means changes an amount of exposing light of said latent image forming means to the original every reproducing characteristic.

15. A system according to claim 11, wherein said latent image forming means has charging means for charging the photo sensitive material, and said control means changes a charging amount of said charging means every gradation characteristic.

16. A system according to claim 11, wherein one of said gradation characteristic is a diagram.

17. A system according to claim 11, wherein one of said gradation characteristics has a wide continuous gradation range.

18. A system according to claim 11, wherein said designating means is a digitizer.

19. A multiple image forming system comprising:
latent image forming means for projecting a reflected light from an original onto a photo sensitive material and forming an electrostatic latent image onto said photo sensitive material;
developing means for developing said latent image;
discriminating means for discriminating the kinds of different gradation characteristics of said original and their areas;
control means for controlling a latent image forming characteristic of the latent image forming means or a developing characteristic of the developing means every gradation characteristic area in accordance with the result of the discrimination of said discriminating means; and
synthesizing means for synthesizing the images which were formed every gradation characteristic.

20. A system according to claim 19, further having erasing means for erasing the latent image in the area having the different kind of gradation characteristic.

21. A system according to claim 19, wherein said control means changes a developing bias of said developing means every gradation characteristic.

22. A system according to claim 19, wherein said control means changes an amount of exposing light of said latent image forming means to the original every reproducing characteristic.

23. A system according to claim 19, wherein said latent image forming means has charging means for charging the photo sensitive material, and said control means changes a charging amount of said charging means every gradation characteristic.

24. A system according to claim 19, wherein one of said gradation characteristics is a diagram.

25. A system according to claim 19, wherein one of said gradation characteristics has a wide continuous gradation range.

26. A system according to claim 19, wherein one of said gradation characteristics has a predetermined background density.

27. A system according to claim 19, wherein said discriminating means detects a density distribution of the original image and discriminates the area and the kind.

28. A system according to claim 19, wherein said discriminating means has detecting means for detecting a density of the original image.

29. A system according to claim 19, wherein said control means controls said latent image forming means and said developing means so as to execute the latent image forming and developing operations only a number of times as many as the number of said discriminated kinds.

30. A multiple image forming system comprising:

latent image forming means for projecting a reflected light from an original onto a photo sensitive material and forming an electrostatic latent image onto said photo sensitive material;

developing means for developing said latent image; and control means for making said latent image forming means and said developing means operative every gradation for different gradation characteristic areas in said original, wherein said control means makes the latent image forming means and the developing means operative only a number of times as many as the number of kinds of the gradation characteristics existing in one original, thereby forming a synthetic image.

31. A system according to claim 30, wherein said control means changes latent image forming conditions of said latent image forming means or developing conditions of said developing means in accordance with the kind of the gradation characteristic.

32. A system according to claim 30, further having a recognizing means for automatically recognizing said gradation characteristic area in the original, and wherein said control means controls said latent image forming means and said developing means in accordance with the result of the area discrimination by said recognizing means.

* * * * *